United States Patent [19]

Segoshi et al.

[11] Patent Number: 4,612,607

[45] Date of Patent: Sep. 16, 1986

[54] AUTOMOTIVE LAMP UNIT

[75] Inventors: Toru Segoshi, Yokohama; Masakazu Mutoh, Atsugi, both of Japan

[73] Assignee: Nissan Motor Co., Ltd., Yokahama, Japan

[21] Appl. No.: 745,522

[22] Filed: Jun. 17, 1985

[30] Foreign Application Priority Data

Jun. 18, 1984 [JP] Japan ..... 59-89420[U]

[51] Int. Cl.[4] ..... F21M 3/02

[52] U.S. Cl. ..... 362/267; 362/345

[58] Field of Search ..... 362/267, 294, 345, 263, 362/64; 315/82

[56] References Cited

U.S. PATENT DOCUMENTS

| | | | |
|---|---|---|---|
| 3,593,017 | 12/1968 | Cibie | 362/294 |
| 3,854,040 | 12/1974 | Heiderer | 362/267 |
| 4,023,059 | 5/1977 | Anderson | 313/640 |
| 4,104,555 | 8/1978 | Fleming | 313/512 |
| 4,280,173 | 7/1981 | Bradley et al. | 362/345 |
| 4,405,974 | 9/1983 | Quiogue | 362/294 |

FOREIGN PATENT DOCUMENTS

| | | | |
|---|---|---|---|
| 55-171902 | 12/1980 | Japan . | |
| 58-73503 | 5/1983 | Japan . | |
| 2116693 | 9/1983 | United Kingdom | 362/294 |

*Primary Examiner*—William A. Cuchlinski, Jr.

*Attorney, Agent, or Firm*—Leydig, Voit & Mayer, Ltd.

[57] ABSTRACT

A desiccant pack is disposed in an automotive lamp unit to adsorb moisture therein. In order to tightly support the pack and protect the same from direct heat emitted from an electric bulb, a heat shielding plate is arranged in the lamp unit. The plate is formed with a plurality of lugs for gripping the pack and is located between the pack and the electric bulb.

9 Claims, 9 Drawing Figures

AUTOMOTIVE LAMP UNIT

BACKGROUND OF THE INVENTION (1) Field of the Invention

The present invention relates in general to automotive lamp units, and more particularly to automotive lamp units of a type which is designed to prevent the collection of moisture on the inner surface of the lens and to maintain the interior of the lamp unit moisture free.

(2) Description of the Prior Art

Hitherto, various kinds of automotive lamp units, such as head lamp, tail lamp, fog lamp, etc., have been proposed and put into practical use. In order to protect the interior of the lamp unit from raindrop, dust or the like, some of the conventional lamp units are of a so-called 'sealed type' which is constructed to hermetically close the interior of the lamp unit from the atmosphere.

However, from the practical point of view, the sealed lamp unit is forced to breathe through any incompletely sealed portions because of the unavoidable expansion-contraction thereof originating from the temperature change of air therein due to ON-OFF operation of the lamp proper. Thus, in fact, the interior of the sealed lamp unit is contaminated but in small amounts, with the surrounding air. Furthermore, some of the sealed lamp units are equipped with an air breather means to prevent breakage thereof originating from the expansion-contraction phenomenon.

Thus, even in the sealed type, the interior of the lamp unit is contaminated with the surrounding air. Due to moisture in air, the inner surface of the lens of the lamp unit is collects moisture thereby deteriorating the light transmission ability thereof.

For solving the above-mentioned undesirable moisture collecting phenomenon, Japanese patent application First Publication No. Sho 49-48788 has proposed a measure of using a desiccant pack in the lamp unit. In this measure, the desiccant pack contains silicagel and is bonded to the inside surface of the lamp unit by means of a suitable adhesive. However, this measure fails to provide satisfaction because the desiccant pack tends to come off from the inside surface of the lamp unit when a considerable shock is applied thereto during moving of the vehicle. Furthermore, in this measure the heat from the electric bulb is directly applied to the desiccant pack thereby to deteriorate the moisture adsorption ability of the same.

SUMMARY OF THE INVENTION

It is therefore an essential object of the present invention to provide an improved automotive lamp unit which can eliminate the drawbacks encountered in the above-mentioned conventional sealed lamp units.

More particularly, the object of the present invention is to provide an automotive sealed lamp unit equipped with a desiccant pack which is tightly mounted in the lamp unit and protected from being directly heated by the electric bulb.

According to the present invention, there is provided an automotive lamp unit which comprises a lamp housing in which an electric bulb is installed, a lens fixed to the lamp housing in a manner to define in the lamp housing a chamber, a heat shielding plate disposed in the chamber, first means for tightly supporting the heat shielding plate in a manner to define a given clearance between the heat shielding plate and the inner surface of the chamber, the clearance being positioned on the opposite side of the plate with respect to the electric bulb, a desiccant back disposed in the given clearance, and second means for fixing the desiccant pack to the heat shielding plate.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
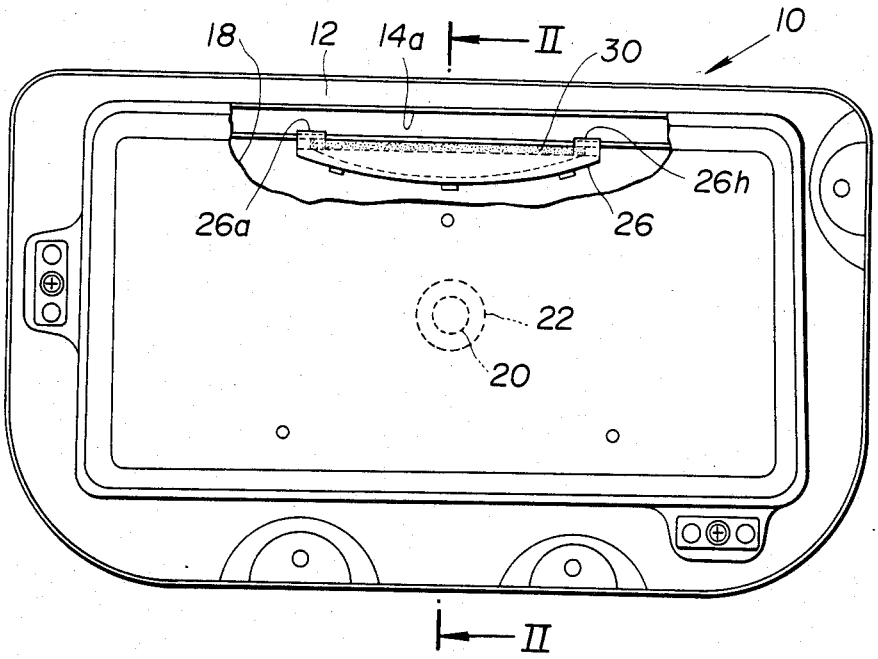
FIG. 1 is a front but partially broken view of an automotive head lamp unit according to the present invention.
Figure 2:
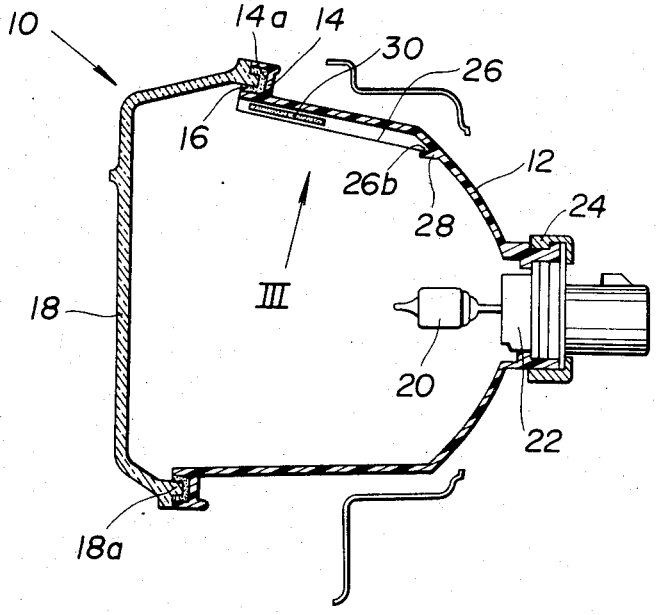
FIG. 2 is a sectional view taken along the line II—II of FIG. 1.

Referring to FIGS. 1 to 9, particularly FIGS. 1 and 2, of the drawings, there is shown an embodiment of the present invention, which is an automotive head lamp unit generally designated by numeral 10.

The head lamp unit 10 comprises a generally rectangular lamp housing 12 having a front opening (no numeral) which is mergined by a peripheral flange 14. The flange 14 has at its front side a groove **14*a* which extends therealong and contains therein a suitable adhesive 16. A rectangular lens 18 is mounted to the lamp housing 12 with its peripheral edge 18*a* the groove 14*a* of the flange 14 of the housing 12. With adhesive 16, the lens 18 is bonded to the housing 12 to provide hermetical sealing therebetween. Designated by numeral 20 is an electric bulb which is received in a bulb socket 22. The socket 22 is detachably fixed to the bottom of the lamp housing 12 through a suitable connector 24**.

A heat shielding plate 26 is attached to the ceiling of the lamp housing 12. For this attachment, the plate 26 has at its front end two spaced bent back portions **26*a* (see FIG. 3) which are hooked to the groove 14*a* of the flange 14 of the housing 12. The rear end portion 26*b* of the plate 26 is put on a ridge 28 (or projection) raised from the inside surface of the housing 12. As is seen from FIG. 2, the heat shielding plate 26 is attached to the ceiling of the lamp housing 12** in a manner to define a given space therebetween.

Within the given space, there is disposed a dessicant pack 30 which is sandwiched between the ceiling of the housing 12 and the heat shielding plate 26.

Figure 3:
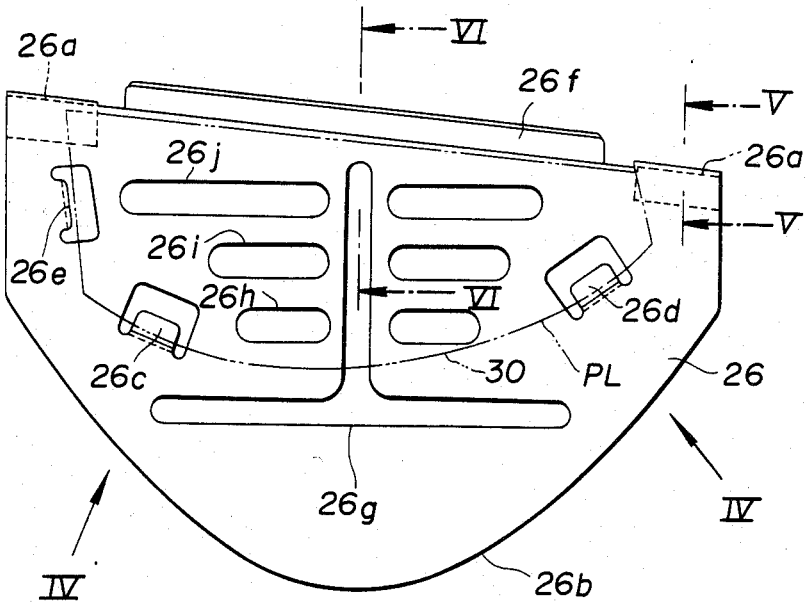
FIG. 3 is a plan view of a heat shielding plate used in the present invention, the view being taken from the direction of the arrow III in FIG. 2.
Figure 4:
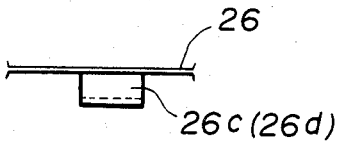
FIG. 4 is a partial view taken from the direction of the arrow IV of FIG. 3.

FIG. 3 shows in detail the heat shielding plate 26. The plate 26 is constructed of an aluminium-plated steel plate of about 0.5 mm thickness. For simplicity, a metal stamping technique is used for producing the plate 26. Of course, any other materials may be used for forming the plate 26 so long as they can withstand heat applied thereto by the electric bulb 20. A metal plate having a high heat reflection surface is preferable.

As is seen from FIG. 3, the heat shielding plate 26 has a smoothly curved rear edge 26*b* which matches in shape with the contour of the rear wall of the lamp housing 12. The crescent-shaped zone enclosed by a phantom line PL is the portion to which the desicant pack 30 is attached. For this pack attachment, the plate 26 has three lugs 26*c*, 26*d* and 26*e* which are stamped up from the major portion of the plate 26. The lugs 26*c* and 26*d* are identical in shape, each having a bent end as is seen from FIG. 4 which is taken from the direction of the arrow IV of FIG. 3. While, the lug 26*e* has no portion corresponding to the bent end of the lugs 26*c* and 26*d*, as will be understood from FIG. 3.

Figure 5:
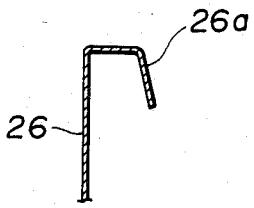
FIG. 5 is a sectional view taken along the line V—V of FIG. 3.
Figure 6:
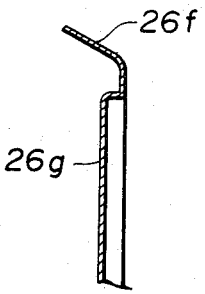
FIG. 6 is a sectional view taken along the line VI—VI of FIG. 3.

The two spaced bent back portions 26*a* (which are to be hooked to the groove 14*a* of the flange 14 of the lamp housing 12) are formed at the laterally opposed sides of the front end of the plate 26. The detailed construction of each bent back portion 26*a* is shown in FIG. 5 which is taken along the line V—V of FIG. 3. The front end of the plate 26 is provided, at the area other than that where the bent back portions 26*a* are provided, with a downwardly bent elongate flange 26*f* the construction of which may be well understood from FIG. 6. Furthermore, the plate 26 is formed with a plurality of elongate embosses 26*g*, 26*h*, 26*i* and 26*j*. These embosses and the elongate flange 26*f* increase the mechanical strength of the plate 26. As is seen from FIG. 3, some of the embosses are located in the cresent-shaped zone PL.

Figure 7:
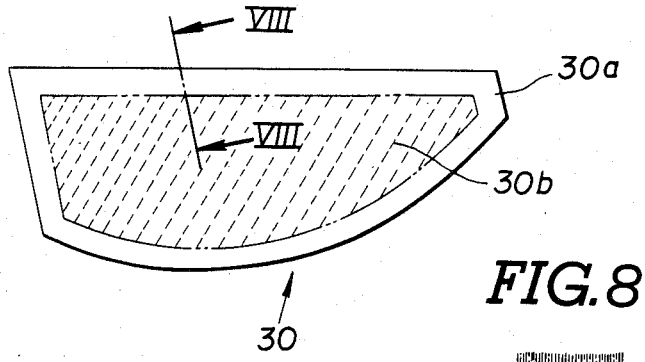
FIG. 7 is a plane view of a desiccant pack used in the present invention.
Figure 8:
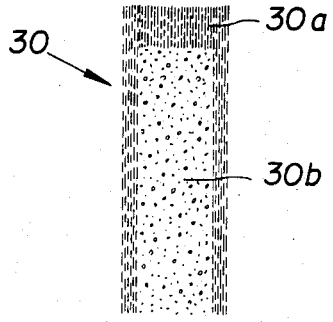
FIG. 8 is a sectional view taken along the line VIII—VIII of FIG. 7.

FIG. 7 shows the desiccant pack 30. The desiccant pack 30 used in the invention comprises an air permeable plastic casing 30*a* and silicagel particles 30*b* contained in the casing 30*a*. Preferably, the casing 30*a* is constructed of a fibrous plastics because of its adequate air permeation. The interior of the desiccant pack 30 will be well understood from FIG. 8 which is a sectional view taken along the line VIII—VIII of FIG. 7.

Figure 9:
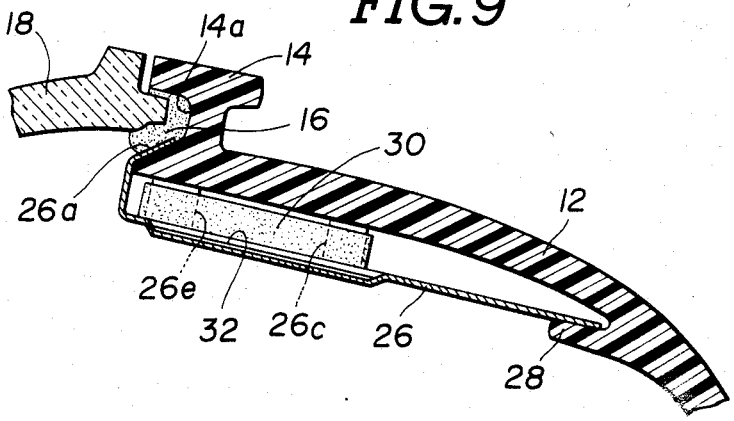
FIG. 9 is a sectional view of a part of the head lamp unit where the desiccant pack is installed.

Referring to FIG. 9, there is shown, in sectional fashion, a part of the lamp unit 10 where the heat shielding plate 26 and the desiccant pack 30 are positioned. Upon assembly, the desiccant pack 30 is fixed to the heat shielding plate 26 with its peripheral portions gripped by the associated lugs 26*c*, 26*d* and 26*e* of the plate 26, then, the pack-mounted plate 26 is attached to the lamp housing 12 having the rear curved edge 26*b* thereof put on the ridge 28, and thereafter, the front end of the plate 26 is fixed to the ceiling of the lamp housing 12 having the two bent pack portions 26*a* hooked to the groove 14*a* of the housing flange 14. With the adhesive 16 in the groove 14*a*, the attachment of the plate 26 to the lamp housing 12 is tightly achieved.

Advantageous features of the present invention are as follows:

First, even when humid air enters the interior of the lamp housing 12, the desiccant pack 30 adsorbs moisture in the air thereby preventing the lens 28 from collecting moisture. Thus, the illumination loss due to the moisture in the lamp unit 10 is not caused or at least minimized.

Second, since the desiccant pack 30 is tightly gripped by the lugs 26*c*, 26*d*. and 26*e* of the heat shielding plate 26, inevitable vibration of the vehicle does not induce looseness and/or disconnection of the desiccant pack 30 from the heat shielding plate 26.

Third, the embosses 26*g*, 26*h*, 26*i* and 26*j* of the heat shielding plate 26 for increasing the mechanical strength of the plate 26 can provide the desiccant pack 30 with air passages 32 (see FIG. 9) between the pack 30 and the heat shielding plate 26. With the air passages 32, the desiccant pack 30 can exhibit its maximum moisture adsorption ability. If desired, several holes may be formed in the plate 26 within the crescent-shaped zone PL in order to assure the air passages.

Fourth, since the heat shielding plate 26 blocks heat rays from the electric bulb 20, the desiccant pack 30 more particularly, the silicagel particles 30*b* contained therein are prevented from thermal deterioration.

While an embodiment of the present invention has been shown and described, it is not intended to limit the same to the details of the construction set forth, but instead, the invention embraces such changes, modifications and equivalents of the various parts and their relationships as come within the purview of the appended claims.

What is claimed is:

1. An automotive lamp unit comprising:

a lamp housing in which an electric bulb is installed;

a lens fixed to said lamp housing in a manner to define in said lamp housing a chamber;

a heat shielding plate disposed in said chamber;

first means for tightly supporting said heat shielding plate in a manner to define a given clearance between said heat shielding plate and the inner surface of said chamber, said clearance being positioned on the opposite side of said plate with respect to said electric bulb;

a desiccant pack disposed in said given clearance; and second means for fixing said desiccant pack to said heat shielding plate.

2. An automotive lamp unit as claimed in claim 1, in which said heat shielding plate is provided with a plurality of embosses for increasing the mechanical strength thereof.

3. An automotive lamp unit as claimed in claim 2, in which said heat shielding plate is constructed of an aluminium-plated steel plate having a high heat reflecting surface.

4. An automotive lamp unit as claimed in claim 2, in which said desiccant pack is located in an area of said heat shielding plate where said embosses are provided.

5. An automotive lamp unit as claimed in claim 4, in which said lens is bonded by means of an adhesive to a grooved periheral edge by which a front opening of said lamp housing is mergined.

6. An automotive lamp unit as claimed in claim 5, in which said first means comprises a ridge projected into said chamber from the inside surface of said lamp housing to support thereon an edge of said heat shielding plate, and a bent back portion formed on the other end of said heat shielding plate and hooked to the joint portion of said lamp housing and said lens.

7. An automotive lamp unit as claimed in claim 6, in which said bent back portion of said heat shielding plate is bonded to said joint portion by means of an adhesive.

8. An automotive lamp unit as claimed in claim 7, in which said second means comprises a plurality of lugs which are stumped up from the major portion of said heat shielding plate, each lug being constructed to grip the associated portion of said desiccant pack upon proper mounting of said pack to said plate.

9. An automotive lamp unit as claimed in claim 1, in which said heat shielding plate is positioned above said electric bulb.

* * * * *